US010036994B2

(12) United States Patent
Nishiyama et al.

(10) Patent No.: US 10,036,994 B2
(45) Date of Patent: Jul. 31, 2018

(54) ELECTRIFIER CLEANING MECHANISM AND IMAGE FORMING APPARATUS

(71) Applicant: Sharp Kabushiki Kaisha, Osaka (JP)

(72) Inventors: Takeshi Nishiyama, Osaka (JP); Yuhsuke Yoshimoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 15/586,834

(22) Filed: May 4, 2017

(65) Prior Publication Data

US 2017/0329276 A1 Nov. 16, 2017

(30) Foreign Application Priority Data

May 11, 2016 (JP) ..... 2016-095188

(51) Int. Cl.
*G03G 21/00* (2006.01)
*G03G 15/02* (2006.01)

(52) U.S. Cl.
CPC ..... *G03G 21/0047* (2013.01); *G03G 15/0258* (2013.01); *G03G 15/0291* (2013.01)

(58) Field of Classification Search
CPC ..... G03G 15/0258; G03G 15/0291
See application file for complete search history.

(56) References Cited

U.S. PATENT DOCUMENTS 4,864,363 A * 9/1989 Shinada ..... G03G 15/0258 355/133
5,182,694 A * 1/1993 Endo ..... G03G 15/0258 361/229
5,250,991 A * 10/1993 Ikeda ..... G03G 15/1635 399/100
5,337,131 A * 8/1994 Sagiv ..... H01T 19/00 250/324
6,415,120 B1 * 7/2002 Tashiro ..... G03G 15/0258 399/100
2002/0118979 A1 * 8/2002 Walgrove, III .... G03G 15/0258 399/100
2003/0231896 A1 * 12/2003 Kikuchi ..... G03G 15/0208 399/100
2007/0065173 A1 * 3/2007 Sekovski ..... G03G 15/0258 399/100
2008/0019728 A1 * 1/2008 Matsuyama ..... G03G 15/0258 399/90

(Continued)

FOREIGN PATENT DOCUMENTS

JP 2005-258018 A 9/2005

*Primary Examiner* — David Bolduc
(74) *Attorney, Agent, or Firm* — Renner Otto Boisselle & Sklar, LLP

(57) ABSTRACT

An electrifier cleaning mechanism includes a cleaning member which makes contact with part of a long discharge member, a ball screw arranged in parallel with a longitudinal direction of the discharge member and rotatably supported, a drive source which rotates the ball screw in both of forward and reverse directions, a holding member which holds the cleaning member and has a screw hole in which a screw part of the ball screw is screwed, and rotation of which in a circumferential direction of the ball screw is regulated, and a pressing member which presses the holding member from a first end side of the discharge member toward a second end side thereof in the longitudinal direction.

7 Claims, 4 Drawing Sheets

(56) References Cited

U.S. PATENT DOCUMENTS

2008/0069586 A1* 3/2008 Dangelmaier ..... G03G 15/0258 399/100
2008/0159776 A1* 7/2008 Tanase ..... G03G 15/0258 399/100
2008/0199206 A1* 8/2008 Zona ..... G03G 15/0258 399/100
2008/0199207 A1* 8/2008 Takayama ..... G03G 15/0258 399/100
2008/0253805 A1* 10/2008 Yoshino ..... G03G 15/0266 399/171
2008/0260417 A1* 10/2008 Hotani ..... G03G 15/0258 399/100
2008/0268361 A1* 10/2008 Kikuchi ..... G03G 15/0258 430/97
2009/0052939 A1* 2/2009 Yoshino ..... G03G 15/0258 399/111
2009/0074444 A1* 3/2009 Kuze ..... G03G 15/0258 399/100
2009/0148173 A1* 6/2009 Tajima ..... G03G 15/0258 399/36
2009/0304410 A1* 12/2009 Tanaka ..... G03G 15/0258 399/100
2010/0054794 A1* 3/2010 Fowler ..... G03G 15/0225 399/100
2010/0067939 A1* 3/2010 Inoue ..... G03G 15/0258 399/100
2010/0158558 A1* 6/2010 Hano ..... G03G 15/0258 399/100
2010/0209134 A1* 8/2010 Yamaguchi ..... G03G 15/0258 399/100
2010/0278548 A1* 11/2010 Burry ..... G03G 15/0258 399/49
2010/0278553 A1* 11/2010 Burry ..... G03G 15/0258 399/100
2010/0322668 A1* 12/2010 Takishita ..... G03G 15/0291 399/170
2011/0222897 A1* 9/2011 Makino ..... G03G 15/0258 399/92
2011/0222898 A1* 9/2011 Kidaka ..... G03G 15/0258 399/97
2011/0222901 A1* 9/2011 Makino ..... H01T 19/00 399/98
2012/0070183 A1* 3/2012 Ikeda ..... G03G 15/0291 399/100
2013/0034367 A1* 2/2013 Hatano ..... G03G 15/0291 399/100
2013/0094878 A1* 4/2013 Ueno ..... G03G 15/0258 399/100
2013/0094879 A1* 4/2013 Ueno ..... G03G 15/0291 399/100
2014/0086601 A1* 3/2014 Hoshino ..... G03G 15/0258 399/34
2014/0348529 A1* 11/2014 Takahashi ..... G03G 15/04036 399/71
2015/0043941 A1* 2/2015 Ueno ..... G03G 15/0291 399/100
2015/0147083 A1* 5/2015 Uenishi ..... G03G 15/0258 399/100

* cited by examiner

ELECTRIFIER CLEANING MECHANISM AND IMAGE FORMING APPARATUS

BACKGROUND

1. Field

The present disclosure relates to, for example, a cleaning mechanism for cleaning a discharge member of an electrifier included in an electrophotographic image forming apparatus.

2. Description of the Related Art

An electrophotographic image forming apparatus may use an electrifier for corona discharge to electrify a surface of an image carrier. In the electrifier, a long discharge member is disposed inside a sealed case. If the discharge member has a soiled portion, uniform electrification over the surface of the image carrier is inhibited, and image quality after image formation is degraded. Thus, the image forming apparatus includes a cleaning member for removing a soiled portion of the discharge member.

In related art, a cleaning device for cleaning a discharge member includes a cleaning member which cleans the discharge member of a corona discharger, a holder which holds the cleaning member, a feed screw which is screwed in a screw part of the holder and is rotated by a driving mechanism, and a stopper member for regulating both ends of a moving range of the holder (for example, refer to Japanese Unexamined Patent Application Publication No. 2005-258018). With this structure, when the cleaning member slidably makes contact with the discharge member for cleaning, the cleaning device described in Japanese Unexamined Patent Application Publication No. 2005-258018 may reduce an impact when the cleaning member turns around at an end of the discharge member or stops, thereby mitigating damage of the cleaning member.

In the disclosure described in Japanese Unexamined Patent Application Publication No. 2005-258018, while the cleaning member and a side wall of the sealed case do not collide with each other, this stopper member is made of hard plastic, and therefore the cleaning member may abut on the stopper member and an impact of this abutting may damage the stopper member or the cleaning member. Moreover, since the stopper member is provided, the sealed case has to be longer by the length of the stopper member than the length of the discharge member in the longitudinal direction, thereby increasing the size of the electrifier to invite an increase in size of the image forming apparatus.

It is desirable to provide an electrifier cleaning mechanism capable of cleaning a discharge member without collision of a cleaning member with a side wall of a sealed case even if the side wall of the sealed case where the discharge member is disposed and an end of the discharge member are arranged adjacently to each other, while mitigating an increase in size of an image forming apparatus.

SUMMARY

In an aspect of the disclosure, a cleaning mechanism includes a cleaning member, a ball screw, a drive source, a holding member, and a pressing member. The cleaning member makes contact with part of a long discharge member. The ball screw is arranged in parallel with a longitudinal direction of the discharge member and rotatably supported. The drive source rotates the ball screw in both of forward and reverse directions. The holding member holds the cleaning member and has a screw hole in which a screw part of the ball screw is screwed, and rotation of the holding member in a circumferential direction of the ball screw is regulated. The pressing member presses the holding member from a first end side of the discharge member toward a second end side thereof in the longitudinal direction.

DESCRIPTION OF THE EMBODIMENTS

Figure 1:
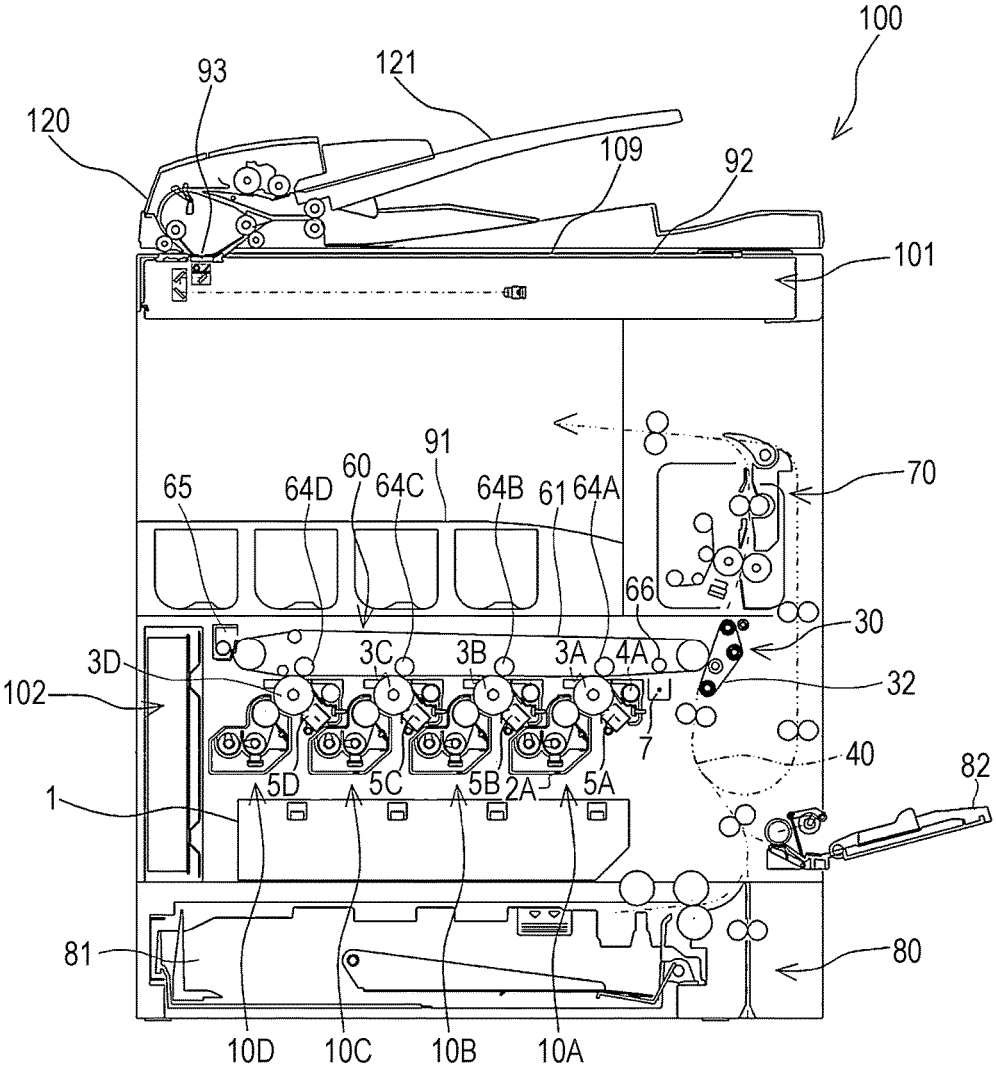
FIG. 1 is a schematic diagram of the structure of an image forming apparatus according to the present disclosure in a front view.

As depicted in FIG. 1, an image forming apparatus 100 includes an image reading unit 101, an image forming unit 102, a control unit (CPU) 103 (refer to FIG. 2), an operating unit 109, and a paper-feeding unit 80. The image forming apparatus 100 uses image data read from a document or image data inputted from an external apparatus to perform electrophotographic multicolor or monochrome image forming process on paper as a recording medium.

The image reading unit 101 includes document tables 92 and 93 on an upper surface for reading image data from a document. On an upper surface of the image reading unit 101, an automatic document conveying apparatus 120 for conveying a document mounted on a mount tray 121 is attached, with a back surface side end as a support axis, so as to be able to open and close the upper surface of each of the document tables 92 and 93. The image reading unit 101 reads image data from a document passing over the document table 93 as being conveyed by the automatic document conveying apparatus 120 or a document mounted on the document table 92 by manual operation by an operator with opening and closing of the automatic document conveying apparatus 120.

The image forming unit 102 uses image data read at the image reading unit 101 to perform electrophotographic multicolor or monochrome image forming process on paper as a recording medium. The image forming unit 102 includes an exposing unit 1, image forming units 10A to 10D, an intermediate transfer unit 60, a secondary transfer unit 30, and a fusing unit 70.

The operating unit 109 includes operation keys and a touch panel. The operation keys accept various operation inputs, and output various operation signals to the CPU 103. The touch panel accepts various operation inputs, outputs various operation signals to the CPU 103, and displays various information. For example, as depicted in FIG. 1, the operating unit 109 can be provided on a front side of the image forming apparatus 100 and on the same plane as the document table 92, or can be provided on an apparatus different from the image forming apparatus 100.

The image forming unit 10A includes a developer 2A, a photosensitive drum (corresponding to an image carrier of the present disclosure) 3A, a cleaner unit 4A, and an electrifier 5A to form an image in black (Bk). The electrifier 5A uniformly electrifies a surface of the photosensitive drum 3A at a predetermined potential. The developer 2A makes an electrostatic latent image formed on the photosensitive drum 3A by exposure by the exposing unit 1 visible as a toner image in Bk. The cleaner unit 4A collects toner left on a peripheral surface of the photosensitive drum 3A. The image forming units 10B to 10D are configured similarly to the image forming unit 10A, and form toner images in cyan (C), magenta (M), and yellow (Y) on surfaces of photosensitive drums 3B to 3D, respectively.

The intermediate transfer unit 60 has an intermediate transfer belt 61, primary transfer rollers 64A to 64D, a pre-transfer charger 7, and an opposing roller 66. The intermediate transfer belt 61 moves along a circulation route of passing through the image forming units 10D, 10C, 10B, and 10A in this order. The primary transfer rollers 64A to 64D are arranged so as to oppose the photosensitive drums 3A to 3D, respectively, across the intermediate transfer belt 61, and perform primary transfer of the toner images formed on the peripheral surfaces of the photosensitive drums 3A to 3D, respectively, onto a surface of the intermediate transfer belt 61.

The pre-transfer charger 7 is a corona discharger, and is arranged on a downstream side of the photosensitive drum 3A and on an upstream side of the secondary transfer unit 30 in a moving direction along the circulation route of the intermediate transfer belt 61. Prior to secondary transfer, the pre-transfer charger 7 provides electric charge with the same polarity as that of the toner to the toner image on the intermediate transfer belt 61.

The secondary transfer unit 30 performs secondary transfer of the toner image on the surface of the intermediate transfer belt 61 onto paper conveyed at a secondary transfer position between the intermediate transfer belt 61 and a secondary transfer belt 32. The toner left on the surface of the intermediate transfer belt 61 after secondary transfer is collected by a cleaning unit 65.

The fusing unit 70 heats and pressurizes the paper passing through the secondary transfer position and having the toner image transferred thereon. The toner image transferred onto the paper is strongly fused on the surface of the paper. The paper passing through the fusing unit 70 is discharged to a paper discharge tray 91 arranged above the image forming unit 102.

The paper-feeding unit 80 has a paper-feeding cassette 81 and a manual feeding tray 82. The paper-feeding cassette 81 accommodates a plurality of sheets of paper for use in image forming process, and is provided below the exposing unit 1. The manual feeding tray 82 is provided on a side surface of the image forming apparatus 100. The paper-feeding unit 80 feeds sheets of paper one by one from the paper-feeding cassette 81 or the manual feeding tray 82 to a paper conveying path 40. The paper conveying path 40 is formed from the paper-feeding unit 80 via a portion between the intermediate transfer belt 61 and the secondary transfer unit 30 and via the fusing unit 70 to the paper discharge tray 91.

First Embodiment

Next, the electrifier 5A and a cleaning mechanism 150 of a first embodiment are described. As described above, the electrifiers 5A to 5D are configured similarly. Here, the cleaning mechanism 150 for cleaning a discharge member 112 disposed in the electrifier 5A is described.

Figure 2:
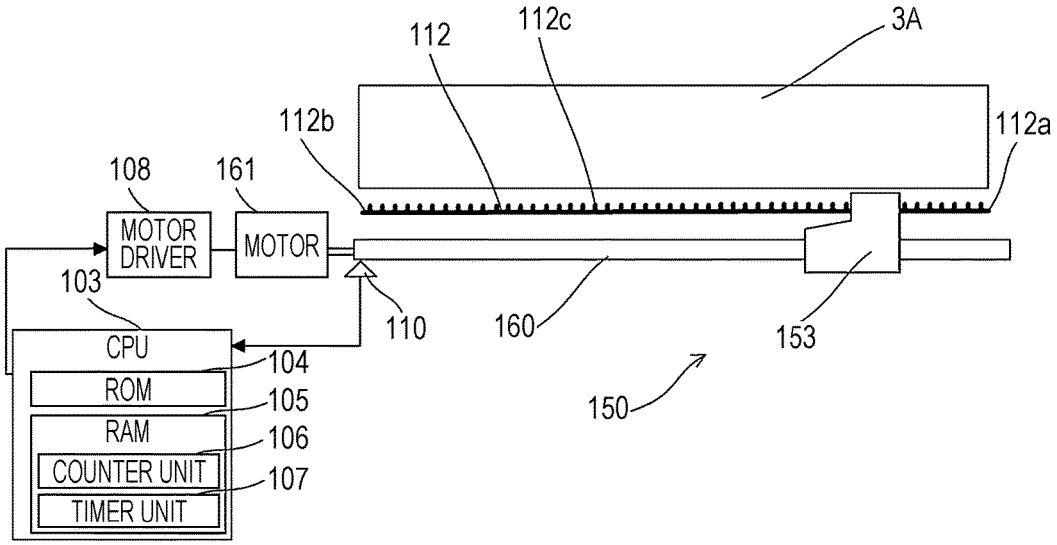
FIG. 2 is a side view schematically depicting the structure of an electrifier cleaning mechanism according to the present disclosure for description.
Figure 3:
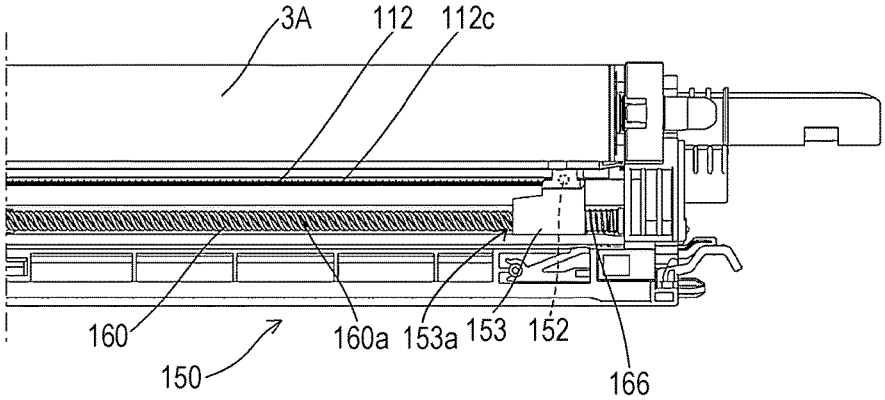
FIG. 3 is a side view of the electrifier cleaning mechanism according to a first embodiment of the present disclosure, depicting a first end side of a discharge member.

As depicted in FIG. 2 and FIG. 3, the cleaning mechanism 150 has a holding member 153, a ball screw 160, a motor 161, a coil spring 166, the CPU 103, a ROM 104, a RAM 105, and a position detection sensor 110. Note that the motor 161 and the coil spring 166 are a drive source and a pressing member, respectively, of the present disclosure.

The discharge member 112 is arranged so that its longitudinal direction matches the axial direction (a main scanning direction) of the photosensitive drum 3A. In the axial direction of the photosensitive drum 3A, a discharge region of the discharge member 112 matches a region including a plane where a toner image transferred onto the photosensitive drum 3A is formed.

The ball screw 160 is arranged along and in parallel with the longitudinal direction of the discharge member 112, and is rotatably supported. The ball screw 160 has a screw part 160*a* corresponding to a space between a first end 112*a* and a second end 112*b* of the discharge member 112. Although depicted in FIG. 2 as a needle-shaped electrode, the discharge member 112 is not particularly restricted as long as it is a long-shaped electrode. For example, an electrode such as a corona wire or creepage electrode can be used. Note that as with FIG. 2, FIGS. 3, 4, and 6 depict the discharge member 112 as a needle-shaped electrode.

The coil spring 166 is mounted at an end of the screw part 160*a* on a first end 112*a* side. The coil spring 166 presses the holding member 153 reaching the first end 112*a* to a second end 112*b* side.

When a cleaning start signal is transmitted by the CPU 103, which is a control unit for controlling the operation of the motor 161, the motor 161 supplies rotation in a forward or reverse direction to the ball screw 160.

The CPU 103 is connected to a motor driver 108. The motor driver 108 is connected to the motor 161 via a worm gear not depicted. Also, the CPU 103 performs centralized control over input/output devices by following a program written in advance in the ROM 104. In the present disclosure, cleaning the discharge member 112 in accordance with a predetermined number of times of image formation is stored in the ROM 104.

In a memory area of the RAM 105, a counter unit 106 and a timer unit 107 are each allocated. The counter unit 106 counts the number of times of image forming process from the previous cleaning. The timer unit 107 measures a rotating time of the motor 161.

The above-mentioned rotating time of the motor 161 is described. A time t during which the holding member 153 is moving between the first end 112*a* and the second end 112*b* is calculated in advance from the pitch and the length in the longitudinal direction of the screw part 160*a* of the ball screw 160, conveying speed of the holding member 153, and so forth. To the time t, a time $\alpha$ is added as a margin time to obtain $(t+\alpha)$, which is taken as a movement time T. The time $\alpha$ is set as an adjustment time for addressing fluctuations of cleaning time due to dimensional error of the ball screw 160 or the like. In the timer unit 107, the movement time T is set as a rotating time of the motor 161.

The position detection sensor 110 is provided on a second end 112*b* side of the discharge member 112. The position detection sensor 110 detects whether the holding member 153 is positioned at the second end 112*b*.

Figure 4:
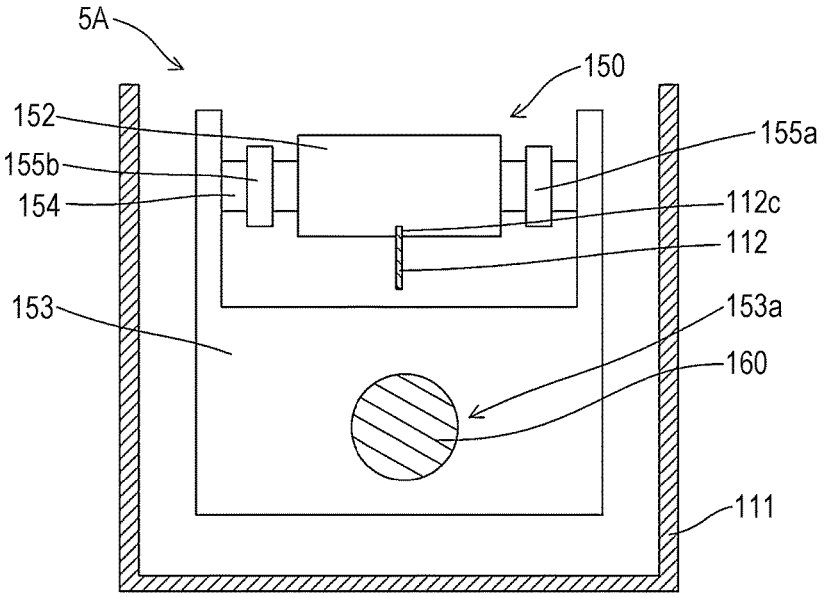
FIG. 4 is a front view schematically depicting the structure of the cleaning mechanism according to the first embodiment of the present disclosure for description, the front view being an enlarged view of main parts.

Next, a specific structure of the electrifier 5A and the cleaning mechanism 150 is described. As depicted in FIG. 4, the electrifier 5A includes a sealed case 111 and the discharge member 112. The sealed case 111 has a rectangular solid shape, with its upper surface open. Also, in the sealed case 111, the discharge member 112 is disposed in the longitudinal direction (refer to FIG. 2).

The cleaning mechanism 150 includes a cleaning member 152, a shaft 154, a rotation support member 155*a*, and a rotation support member 155*b*. The cleaning member 152 abuts on a tip 112*c* of the discharge member 112, and performs cleaning while moving along the longitudinal direction of the discharge member 112. The cleaning member 152 has a roll shape, is arranged at a position opposing the discharge member 112, and makes contact with part of the discharge member 112. The cleaning member 152 is provided on the outer periphery of the shaft 154 and between the rotation support member 155*a* and the rotation support member 155*b*.

The holding member 153 holds the cleaning member 152 so that the cleaning member 152 can abut on the tip 112*c* of the discharge member 112, and also moves with the rotation of the ball screw 160. The holding member 153 rotatably fixes both ends of the shaft 154, thereby rotatably holding the cleaning member 152. Also, the holding member 153 is provided with a screw hole 153*a* for having the screw part 160*a* of the ball screw 160 screwed therein.

When the ball screw 160 rotates with the screw part 160*a* of the ball screw 160 screwed in the screw hole 153*a* of the holding member 153, the ball screw 160 changes this rotating motion to linear motion. This allows the holding member 153 to move with the rotation of the ball screw 160. Here, the holding member 153 is regulated so as not to rotate in a circumferential direction of the ball screw 160.

When the motor 161 supplies rotation to the ball screw 160 under the control by the control unit 103 to cause the ball screw 160 to rotate, the holding member 153 moves from the second end 112*b* to the first end 112*a*. When the holding member 153 reaches the first end 112*a*, screw engagement between the screw hole 153*a* of the holding member 153 and the screw part 160*a* of the ball screw 160 is released. Therefore, the holding member 153 stops at the first end 112*a*. Thus, the holding member 153 does not collide with a side wall of the sealed case 111 on a first end 112*a* side.

With this, the electrifier 5A with the first end 112*a* of the discharge member 112 and the side wall of the sealed case 111 arranged adjacently to each other can be configured. As a result, an increase in size of the image forming apparatus 100 with the electrifier 5A disposed therein can be mitigated.

Also, as depicted in FIG. 2 and FIG. 3, since the holding member 153 reaching the first end 112*a* is pressed by the coil spring 166 toward the second end 112*b*, the screw part 160*a* of the ball screw 160 is again screwed in the screw hole 153*a* of the holding member 153. Here, when the motor 161 supplies reverse rotation to the ball screw 160 to cause the ball screw 160 to rotate reversely, the holding member 153 moves from the first end 112*a* to the second end 112*b*.

In this manner, the cleaning member 152 cleans the discharge member 112 while the holding member 153 is making reciprocating movements between the first end 112*a* and the second end 112*b* of the discharge member 112.

Figure 5:
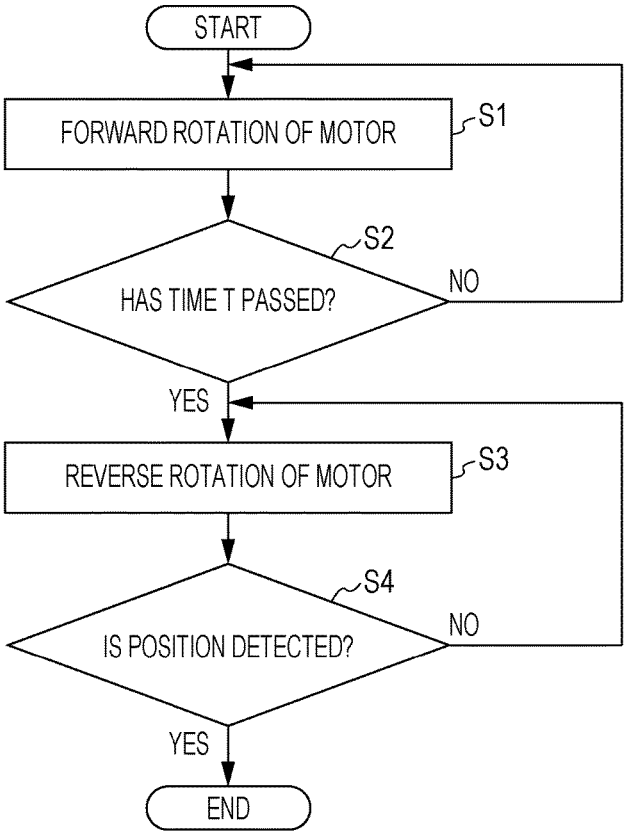
FIG. 5 is a flowchart for describing control of the electrifier cleaning mechanism according to the first embodiment of the present disclosure.

Next, the operation of the cleaning mechanism 150 is described based on FIG. 5. First, the holding member 153 is ready at the second end 112*b*. When cleaning of the discharge member 112 starts, the CPU 103 outputs a signal for controlling the operation of the motor driver 108 to cause the motor 161 to rotate forward for the time T. The ball screw 160 rotates by following the forward rotation supplied from the motor 161 (S1). This causes the holding member 153 to move forward from the second end 112*b* to the first end 112*a*.

After the time T has passed (YES at S2), the CPU 103 outputs a signal for controlling the operation of the motor driver 108 to cause the motor 161 to rotate reversely for the time T. The ball screw 160 rotates by following the reverse rotation supplied from the motor 161 (S3). This causes the holding member 153 to move to return from the first end 112*a* to the second end 112*b*.

If the time T has not passed (NO at S2), the CPU 103 continues to cause the motor 161 to rotate forward.

After S3, the position detection sensor 110 detects whether the holding member 153 is positioned at the second end 112*b*. If the position detection sensor 110 detects that the holding member 153 is positioned at the second end 112*b* (YES at S4), cleaning of the discharge member 112 ends.

If the holding member 153 is not positioned at the second end 112*b* (NO at S4), the CPU 103 continues to cause the motor 161 to rotate reversely.

Second Embodiment

In the cleaning mechanism 150 of the first embodiment, the coil spring (pressing member) 166 is provided at the first end 112*a* of the ball screw 160. A cleaning mechanism 170 of a second embodiment is configured to further have a similar structure provided to an end of the second end 112*b*.

Figure 6:
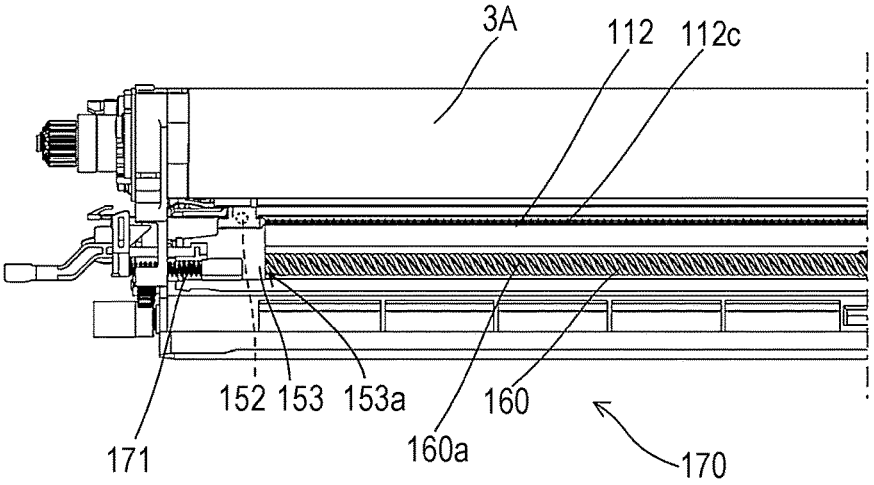
FIG. 6 is a side view of an electrifier cleaning mechanism according to a second embodiment of the present disclosure, depicting a second end side of a discharge member.

As depicted in FIG. 6, in the cleaning mechanism 170 of the second embodiment, a coil spring 171 is provided on a second end 112*b* side of the ball screw 160. With this, when the holding member 153 reaches the second end 112*b*, screw engagement between the screw hole 153*a* and the screw part 160*a* of the ball screw 160 is released, thereby causing the holding member 153 to stop at the second end 112*b*. Note that the coil spring 171 is a pressing member of the present disclosure.

With the above-described structure, the holding member 153 does not collide with the side wall of the sealed case 111. Therefore, the electrifier 5A with the second end 112*b* of the discharge member 112 and the side wall of the sealed case 111 arranged adjacently to each other can be configured. As a result, an increase in size of the image forming apparatus 100 with the electrifier 5A disposed therein can be mitigated.

The cleaning operation of the cleaning mechanism 170 is similar to that of the cleaning mechanism 150 of the first embodiment.

Also, when the holding member 153 moves to return from the first end 112*a* to the second end 112*b* to reach the second end 112*b*, screw engagement between the screw hole 153*a* and the screw part 160*a* of the ball screw 160 is released. Then, at the second end 112*b*, the screw part 160*a* of the ball screw 160 is again screwed into the screw hole 153*a*. Here, when the motor 161 is rotated forward for the time T, the ball screw 160 rotates by following the forward rotation supplied from the motor 161. This allows the holding member 153 to move forward from the second end 112*b* to the first end 112*a*. In this manner, the holding member 153 can perform cleaning by making reciprocating movements between the first end 112*a* and the second end 112*b*.

Third Embodiment

In the cleaning mechanism 150 of the first embodiment and the cleaning mechanism 170 of the second embodiment, the position detection sensor 110 is provided at the second end 112*b*. A cleaning mechanism 180 of a third embodiment (not depicted) may be configured to have a coil spring 171 provided to this position detection sensor 110.

In this case, the position detection sensor 110 intrinsically included in the electrifier 5A is used. Therefore, the number of components can be reduced, and the structure of the cleaning mechanism 180 is simplified.

The cleaning operation of the cleaning mechanism 180 is similar to that of the cleaning mechanism 150 of the first embodiment.

Fourth Embodiment

In the above-described cleaning mechanisms 150, 170, and 180, a coil spring is used as a pressing member. In a cleaning mechanism 190 of a fourth embodiment, a pressing member with an initial pressing force by elastic deformation being smaller than a terminal pressing force may be used. As this pressing member, a non-linear spring is used. Examples may include one having a plurality of coil springs with different pitches arranged in series to make a spring constant variable, one with varied numbers of turns, or one with an unsteady thickness of a wire rod (all of these are not depicted).

If the non-linear spring as described above is used, an optimum pressing member can be designed in accordance with the moving speed of the holding member 153 and the size of the ball screw 160. Also, a plurality of non-linear springs may be combined.

Fifth Embodiment

A cleaning mechanism 200 of a fifth embodiment is configured to have a pressing member 201 provided to the holding member 153.

Figure 7:
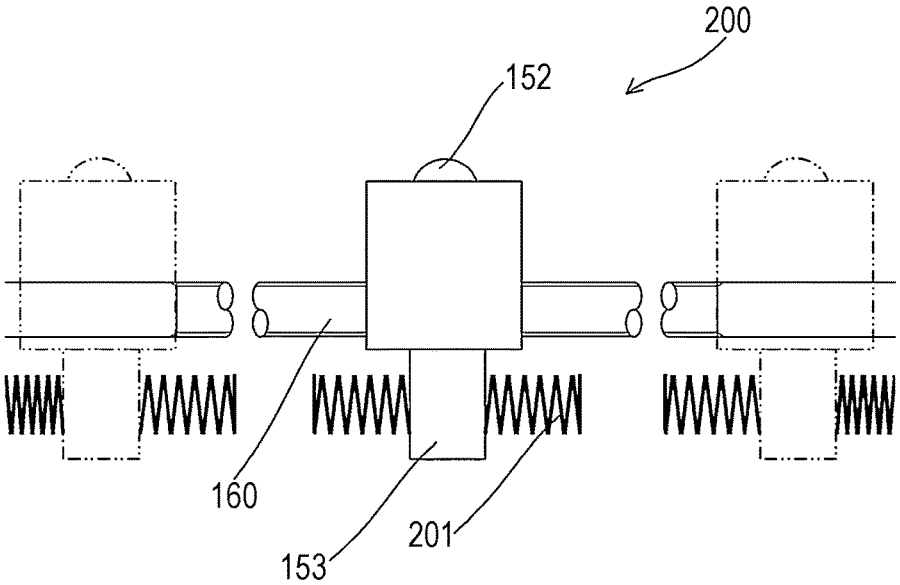
FIG. 7 is a side view of an electrifier cleaning mechanism according to a fifth embodiment of the present disclosure.

As depicted in FIG. 7, if the pressing member 201 is provided to the holding member 153, pressing members do not have to be provided at the first end 112*a* and the second end 112*b* of the discharge member 112. When the holding member 153 reaches the first end 112*a* or the second end 112*b* of the discharge member 112, the pressing member 201 abuts on the side wall of the sealed case 111 to cause a pressing force. This allows the holding member 153 to move from the first end 112*a* side toward the second end 112*b* side or from the second end 112*b* side toward the first end 112*a* side.

Note that the electrifier cleaning mechanism of the present disclosure can be applied to the pre-transfer charger 7.

It is to be understood that the above descriptions of the embodiments are exemplarily made in all aspects and are not restrictive. The scope of the present disclosure is indicated not by the above-described embodiments but by the scope of the appended claims. Furthermore, the scope of the present disclosure is intended to include all modifications within the sense and scope of the equivalents of the scope of the appended claims.

The present disclosure contains subject matter related to that disclosed in Japanese Priority Patent Application JP 2016-095118 filed in the Japan Patent Office on May 11, 2016, the entire contents of which are hereby incorporated by reference.

What is claimed is:

1. An electrifier cleaning mechanism comprising:

a cleaning member which makes contact with part of a long discharge member;

a ball screw arranged in parallel with a longitudinal direction of the discharge member and rotatably supported;

a drive source which rotates the ball screw in both of forward and reverse directions;

a holding member which holds the cleaning member and has a screw hole in which a screw part of the ball screw is screwed, and rotation of which in a circumferential direction of the ball screw is regulated; and a pressing member which presses the holding member from a first end side of the discharge member toward a second end side thereof in the longitudinal direction, wherein when the holding member reaches the first end, screw engagement between the screw hole and the screw part is released, such that the holding member is stopped at the first end.

2. The electrifier cleaning mechanism according to claim 1, wherein the screw part of the ball screw has at least an end on the first end side matching the first end side in a cleaning range of the discharging member.

3. The electrifier cleaning mechanism according to claim 1, wherein the pressing member causes a pressing force by elastic deformation along the longitudinal direction.

4. The electrifier cleaning mechanism according to claim 1, wherein while an elastic deformation of the pressing member is caused by the holding member from the second end side, a pressing force generated at a beginning of the elastic deformation is smaller than a pressing force generated at an ending of the elastic deformation.

5. An image forming apparatus comprising the electrifier cleaning mechanism according to claim 1 and performing electrophotographic image formation.

6. The electrifier cleaning mechanism according to claim 1, wherein the pressing member has a varied spring constant.

7. The electrifier cleaning mechanism according to claim 6, wherein the pressing member includes at least one spring having different pitches, varied numbers of turns, or an unsteady wire thickness.

* * * * *